United States Patent [19]

Beardsley et al.

[11] Patent Number: 4,733,268

[45] Date of Patent: Mar. 22, 1988

[54] VOLTAGE CONTROL BAR FOR ELECTROPHOTOGRAPHY

[75] Inventors: Gary S. Beardsley, Morgan Hill; Michael H. Lee, San Jose, both of Calif.

[73] Assignee: International Business Machines Corporation, New York, N.Y.

[21] Appl. No.: 861,487

[22] Filed: May 9, 1986

[51] Int. Cl.[4] ..... G03G 15/08

[52] U.S. Cl. ..... 355/3 DD; 355/14 D; 355/15

[58] Field of Search ..... 355/3 DD, 14 D, 15, 355/3 R; 361/212, 220, 221, 222

[56] References Cited

U.S. PATENT DOCUMENTS

| | | | |
|---|---|---|---|
| 3,767,971 | 10/1973 | Patrick, Jr. | 361/222 |
| 3,884,572 | 5/1975 | Bacon et al. | 355/15 |
| 4,426,151 | 1/1984 | Aguor et al. | 355/15 |
| 4,478,510 | 10/1984 | Fujii et al. | 355/15 |
| 4,521,098 | 6/1985 | Hosoya et al. | 355/3 DD |
| 4,540,272 | 9/1985 | Abe et al. | 355/3 DD X |
| 4,568,955 | 2/1986 | Hosoya et al. | 355/3 DD X |
| 4,611,900 | 9/1986 | Folkins | 355/3 DD |
| 4,627,717 | 12/1986 | Thompson et al. | 355/15 |

FOREIGN PATENT DOCUMENTS 2065557A 7/1981 United Kingdom .

*Primary Examiner*—A. C. Prescott
*Attorney, Agent, or Firm*—Joseph G. Walsh

[57] ABSTRACT

An electrophotographic apparatus is provided with an electrically conductive voltage control bar between the photoconductor drum or belt and the developer or developer/cleaner roll. The voltage control bar prevents toner filming on said cleaning roll, and makes it possible for that roll to be made of an insulating material such as molded plastic.

5 Claims, 1 Drawing Figure

VOLTAGE CONTROL BAR FOR ELECTROPHOTOGRAPHY

TECHNICAL FIELD

The present invention is concerned with electrophotography. Specifically, it is concerned with placing an electrically conductive voltage bar between the photoconductor drum or belt and the developer/cleaner roll of an electrophotographic apparatus.

BACKGROUND ART

U.S. Pat. No. 3,884,572 discloses a roll made of materials which may be somewhat insulating, but the roller is used exclusively as a cleaner that works by mechanically rubbing toner from the surface of the photoconductor. Its purpose is to replace fiber brush or fur brush cleaners commonly used at the time of the patent. In the present invention, a plastic roll may be used, but it does not touch the photoconductor and is used only for transporting mix.

U.S. Pat. No. 4,478,510 discloses a system for placing toner on a substrate, pel by pel, by shooting toner from a developer roll through an opening in a strip. This is done with an electric field between the developer roll and electrodes in the strip to pop the toner off the roll. In the present invention, we develop toner from a toner-carrier mix moving between the bar of the photoconductor. The electric field is applied between these two, in contrast to the situation in that patent. The toner itself jumps from the carrier, not the developer roll.

United Kingdom Pat. No. 2,065,557 discloses a monocomponent cleaning system with a rotating magnet assembly rather than the conventional stationary one. The patent is similar to two component magnetic brush cleaning systems but for monocomponent toner. Although the drawings superficially resembles that of the present invention, it is obvious that the patent is totally irrelevant to the present invention.

DISCLOSURE OF THE INVENTION

Electrophotographic systems have employed magnetic brush development systems in various forms since its invention. It is currently almost the only means by which toner is applied to the photoconductor. It basically consists of a metal roll surrounding a set of magnets. The rotation of the roll and magnetic field together transports the developer mix against the photoconductor, allowing the toner to transfer where the voltage between the roll and the photoconductor is appropriate. In the present invention, we separate the two functions of the developer roll - transport of the mix and transfer of the toner - by placing a stationary conductive bar between the roll and the photoconductor.

The present invention has several advantages over the conventional system. The bar is used as the developer or development/cleaning electrode (two-cycle process). The bar is an electric conductor placed between the magnetic cleaning roll and the photoconductor. It should be sufficiently wide so that the carrier chains do not simultaneously touch the roll and the photoconductor. Since the bar acts as the electrode in place of the roll, the bar-photoconductor separation should be comparable to the original roll-photoconductor separation in the absence of the bar. For the simplest situation, the magnetic cleaner roll and the voltage control bar are electrically connected.

The use of the bar frees the roll from the burden of maintaining the proper potential. In this fashion, two needs for the roll are circumvented; (1) voltage control and (2) precise fabrication. It is no longer necessary for the roll to be fabricated to precise dimensions because the previous requirement for uniform development has not been transferred to the bar. Roller runout affects the mix volume only very slightly, because the bar has a slight averaging affect on the amount that gets to the nip. For these reasons it is now possible to make the magnetic cleaning roll of an insulating material. In particular, such an insulating material can be molded plastic. The ease and cost of producing the roll are therefore markedly reduced compared to corresponding machined metal parts.

The use of an insulating material for the magnetic cleaning roll can lead to charge build-up on the roll. Excessive change accumulation is eliminated by brushing a metal strip against the roll. This strip is to control the charge rather than toner filming.

It is thus seen that the present invention makes possible the use of an inexpensive insulating material instead of an expensive metal conductor and it also permits the use of a roll not necessarily machined to close tolerances.

The voltage control bar is also advantageous in a two-cycle electrophotographic process. Conventionally the developer/cleaner roll has a propensity to film during the cleaning cycle because the process of removing toner from the photoconductor develops toner on the roll. This toner can then smear on the roll, which is very undesirable. According to the present invention, such toner film development on the magnetic roll is eliminated by the use of the voltage control bar.

During the entire electrophotographic cycle, no electric field exists between the bar and the roll, and no toner develops on the roll. When necessary, the voltage between the roll and the bar can be adjusted to achieve this result of no toner accumulation. Because the large electric field is confined to the region between the roll and the photoconductor, any toner that would have developed on the roll without the bar during the cleaning deposits instead on the bar.

DESCRIPTION OF THE DRAWING

An understanding of the present invention is facilitated by reference to the accompanying drawing.

Figure 1:
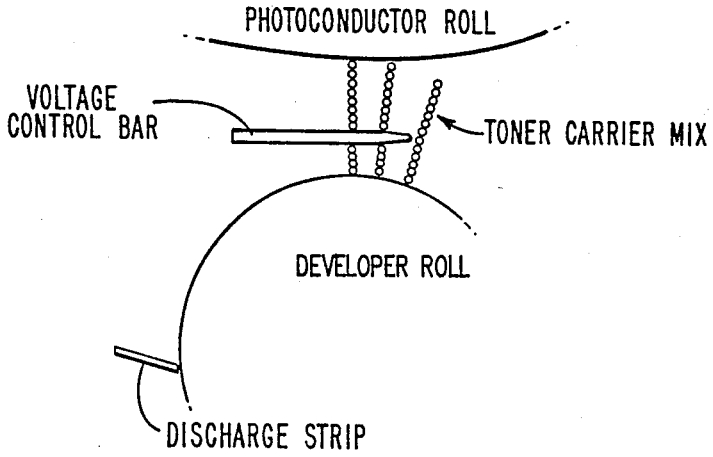
FIG. 1 is a side view, not to scale, of the apparatus of the present invention. As may be seen by inspection of the drawing, a photoconductor roll is separated from a magnetic cleaning roll. Toner carrier mix in the form of chains leaves the photoconductor roll and moves toward the magnetic cleaning roll. An electrically conductive voltage control bar is inserted into the space between the photoconductor drum or belt and the cleaning roll. Toward the bottom of the cleaning roll a metal discharge strip brushes against it if the roll needs to be discharged.

The following example is given to illustrate a preferred mode of operating the present invention. A stainless steel bar 320 mil wide and 20 mil thick, spanning the length of the developer roll, was used on a developer-cleaner in a robot with the photoconductor drum. In the absence of the bar, the magnetic roll was found to be covered with toner after a minute of operation with development/cleaning voltage alternately applied.

With the bar, absolutely no toner was seen on the roll after ten minutes of such operation. The bar itself was also clean, probably from the much larger relative motion of the mix in the region of high field. Toner was developed on the photoconductor during the development cycle, showing that sufficiently large fields existed between the bar and the photoconductor. The mix was found to flow in the bar-voltage conductor region as if the bar were absent. The leading edge of the bar, however, had to be sufficiently sharpened to separate the mix into the two regions.

We claim:

1. An electrophotographic apparatus comprising a photoconductor drum or belt and a developer or developer/cleaner roll in a fixed position so that a space is provided between said drum or belt and said roll, a developer mix of toner and carrier in the form of chains provided in the space between said drum and said roll, said space being chosen so that said chains do not simultaneously contact both said drum and said roll, said apparatus characterized by the improvement that an electrically conductive voltage control bar is inserted into said space between said photoconductor drum or belt and said roll whereby toner buildup on said roll is minimized.

2. An apparatus as claimed in claim 1 wherein the developer or developer/cleaner roll and the voltage control bar are electrically connected to each other.

3. An apparatus as claimed in claim 1 wherein the developer or developer/cleaner roll is made of an electrically insulating material.

4. An apparatus as claimed in claim 3 wherein said insulating material is molded plastic.

5. An apparatus as claimed in claim 3 wherein charge accumulation is eliminated by brushing a conductive strip against the developer or developer/cleaner roll.

* * * * *